United States Patent [19]

Van Riet

[11] Patent Number: 4,987,946

[45] Date of Patent: Jan. 29, 1991

[54] VALVE FOR MOLD CAVITY GAS REMOVAL SYSTEM

[75] Inventor: Joannes A. Van Riet, Bedford, Ind.

[73] Assignee: General Motors Corporation, Detroit, Mich.

[21] Appl. No.: 402,031

[22] Filed: Sep. 5, 1989

[51] Int. Cl.[5] ..... B22D 17/20

[52] U.S. Cl. ..... 164/305; 164/410; 425/420; 425/810

[58] Field of Search ..... 164/305, 410; 425/420, 425/812

[56] References Cited

U.S. PATENT DOCUMENTS 4,782,886 11/1988 Uchida ..... 164/3.5

*Primary Examiner*—Kuang Y. Lin

*Attorney, Agent, or Firm*—Douglas D. Fekete

[57] ABSTRACT

An improved gas venting valve is provided for use with a material-forming mold or die cavity to control venting of gas through a gas conduit communicating with the cavity. The gas venting valve includes a hollow piston axially movable in a housing and having a valve head connected thereto for movement between open and closed positions relative to a valve seat. The valve seat is disposed in a portal of the housing communicating with the gas conduit. In the open position, a gas venting passage internal of the piston is communicated to the portal by the open valve for venting gas from the cavity as material is introduced therein. In the closed position, the valve head is sealed against the valve seat to prevent material introduced into the mold cavity from escaping. The piston is axially moved in the housing by application of pressurized fluid to respective pressure responsive surfaces on the piston.

7 Claims, 3 Drawing Sheets

VALVE FOR MOLD CAVITY GAS REMOVAL SYSTEM

FIELD OF THE INVENTION

The present invention relates to a system for removing gas from the mold cavity of a die casting or other molding machine and, in particular, to an improved gas venting valve for use in such a system.

BACKGROUND OF THE INVENTION

In die casting, molten metal is injected by a shot plunger into a fixed-volume cavity defined by die sections. Air displaced from the die cavity by the cast metal is vented through a conduit in the die. Alternately, the conduit may be connected to a vacuum source to evacuate the cavity prior to casting, thereby further reducing gas entrapment in the casting.

It is known to incorporate into the conduit a valve having an open position for gas venting and a closed position to prevent the escape of cast metal through the conduit. U.S. Ser. No. 174,572, filed by Priem on Mar. 29, 1988, describes an axial impingement type of valve for this purpose wherein valve closure is actuated by impingement of cast metal against a valve head. A pneumatic pulse may be provided to assist in triggering the closure of the valve. This valve has not been entirely satisfactory for casting large products that require a massive, multi-sectional die, such as automotive automatic transmission housings that may weigh more than 35 pounds. The valve is adapted to be located near the die periphery. This location results in an extended conduit that increases the amount of scrap metal for each casting. Furthermore, within the environment of a large die casting operation, a valve of the axial melt impingement type is prone to malfunction and requires frequent maintenance and repair. A second common type of valve for a die casting gas venting system comprises a valve head connected to a hydraulic cylinder. The hydraulic cylinder opens or closes the valve in response to signals dependent upon predetermined points during the casting cycle. While the fluid-actuated valve is reliable to assure timely closure and avoid catastrophic metal escape, such valves have also been designed to be mounted near the die periphery for suitable connection to the fluid cylinder and have featured a limited valve opening insufficient to accomodate the flow of gas from the large die cavity within the allotted cycle time.

Therefore, it is an object of this invention to provide an improved valve for a die casting gas venting system, which valve opens and closes in response to fluid pressure and features a compact design suitable for convenient incorporation into a die body, including, for example, within the interior of a massive die required for large castings.

SUMMARY OF THE INVENTION

The present invention contemplates an improved gas venting valve for use with a material-forming mold or die cavity and overcoming the disadvantages enumerated hereinabove for the gas removal valves heretofore used.

The improved gas venting valve of the invention comprises a housing having a generally cylindrical bore with a longitudinal axis and a portal to the bore. The portal includes a valve seat and is so disposed axially relative to the bore as to communicate with a gas conduit communicating with the mold or die cavity. A hollow piston is slidably received in the bore and includes an axially extending internal gas venting passage in communication with the portal when the valve is in an open position for allowing gas venting from the mold or die cavity.

A valve head is connected to the piston for axial movement therewith relative to the valve seat in the portal. An open valve position is established when the valve head is spaced axially from the valve seat to allow as venting and a closed position is established when the valve head is sealed against the valve seat. preferably, the valve head is connected to an internal support web of the hollow piston. The support web includes a plurality of axially extending gas passages therethrough to communicate the portal and the internal gas venting passage when the valve head is open.

The hollow piston includes first and second radially extending surfaces responsive to fluid pressure for moving the piston in opposite first and second axial directions to position the valve head in the open and closed positions. Means is provided for supplying pressurized fluid to the respective first and second surfaces of the piston.

In a typical working embodiment of the invention, a vacuum means, e.g., a vacuum pump, is connected to the gas venting passage of the hollow piston at an end thereof remote from the housing portal for withdrawing gas from the die cavity when the valve is in the open position. A source of gaseous pressure (e.g., pressurized air) is alternately connected to the gas venting passage for discharge past the valve head in the open position after the die sections are opened to eject the casting. The air blast past the valve head cleans the valve head/valve seat of metal slivers/crumbs and the like.

DETAILED DESCRIPTION OF THE INVENTION

Figure 1:
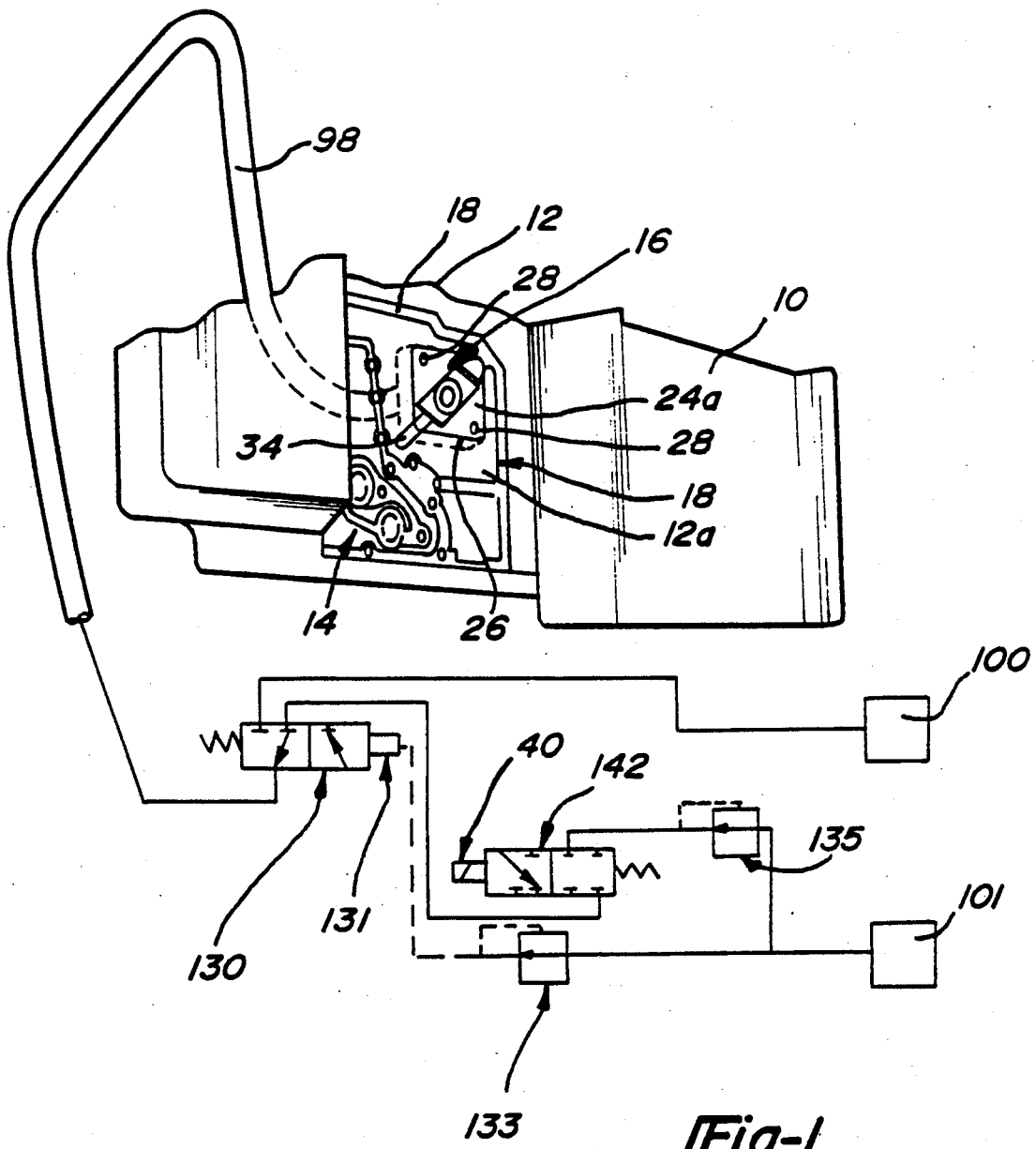
FIG. 1 is a partial perspective view of a die casting mold showing the gas venting valve of the invention as well as a vacuum pump and pressurized air source operatively associated with the gas venting valve.

FIG. 1 illustrates mold or die sections 10, 12 of a metal die casting machine. The die section 10 is movable toward the stationary die section 12 to define, when closed, a mold cavity (partially shown as 14) for receiving molten metal, such as aluminum or zinc, injected thereinto by a shot rod (not shown) in accordance with known die casting methods. The stationary die section 12 includes the gas venting valve 16 of the invention for venting gas from the mold cavity when the molten metal is injected into the mold cavity by the shot rod. To this end, the mold cavity is communicated to the gas venting valve 16 by means of a gas conduit 18 formed on one or both of the die sections 10, 12 (e.g., as shown on die section 12 in FIG. 1). The gas venting valve 16 is shown mounted on the die section 12 within the periphery of the gas conduit 18.

The gas venting valve 16 of the invention is shown in greater detail in FIGS. 2–5. In particular, the valve 16 includes a housing 22 having a base 24 of general square profile, FIG. 2. The base 24 is adapted to be received in a complementary configured recess 26 in the die section 12, FIGS. 1 and 4, and is fastened to the die section 12 by threaded fasteners 28 recessed into the base 24. The base 24 includes a surface **24*a* positioned generally coplanar with the adjacent surface 12*a* of the die section 12 when the valve 16 is fastened in recess 26**.

Figure 3:
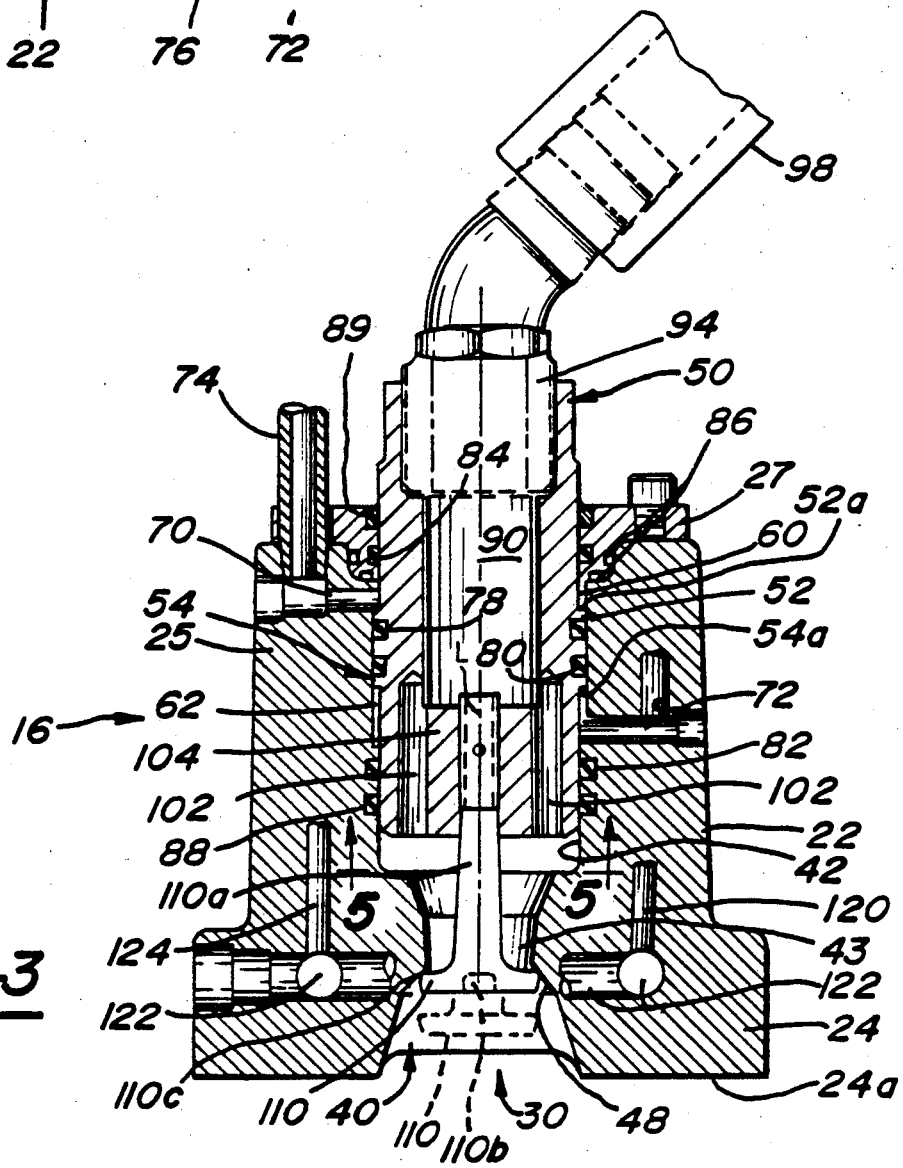
FIG. 3 is a sectional view taken along lines 3—3 of FIG. 2.
Figure 4:
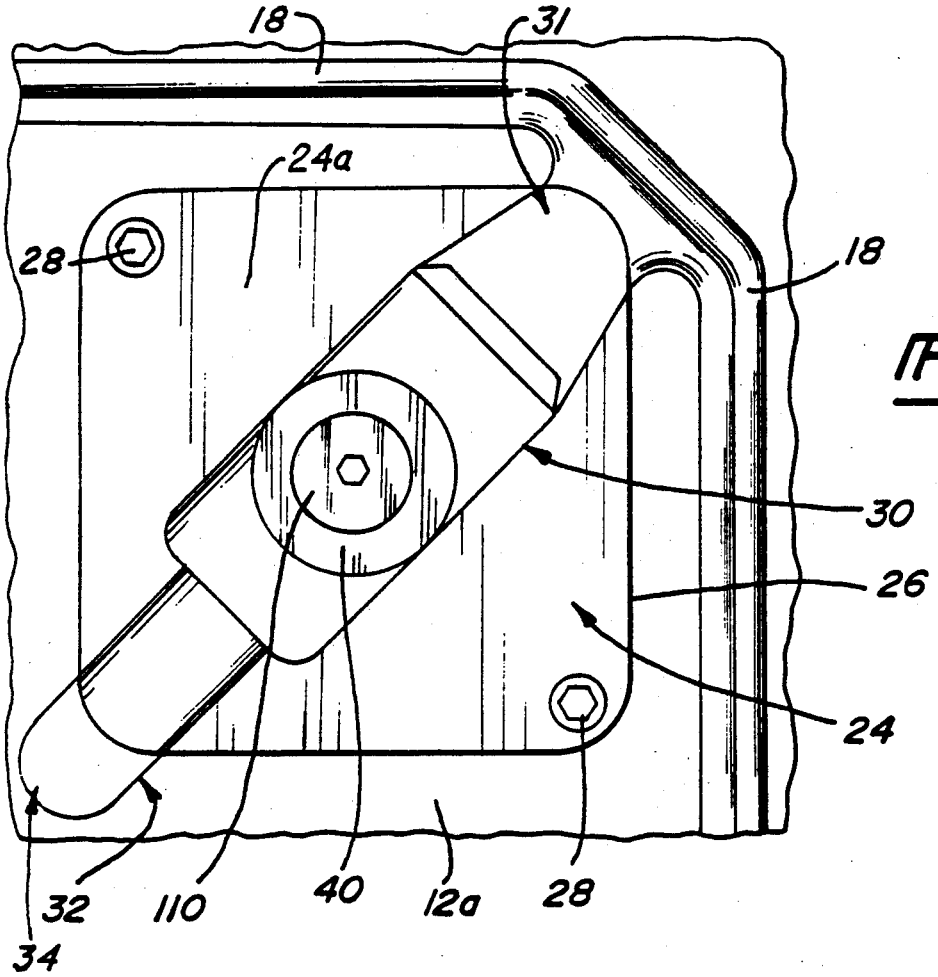
FIG. 4 is a bottom elevational view of the gas venting valve of the invention on the partially shown casting mold.
Figure 5:
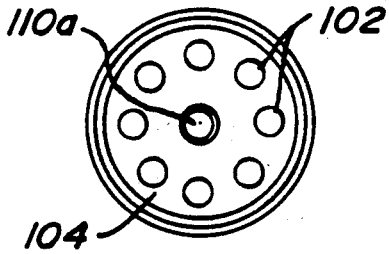
FIG. 5 is an elevational view taken in the direction of arrows 5—5 in FIG. 3.

As shown best in FIGS. 3 and 4, the base surface **24*a* includes a diagonally extending, recessed channel 30 that communicates at one end 31 with the gas conduit 18 extending from the die cavity (e.g., from die cavity portion 14 shown in FIG. 1) and at an opposite end 32 with a recessed, "crumb-catcher" channel 34 formed in the die section 12. As will be explained hereinbelow, the "crumb-catcher" channel 34 captures solidified metal particles that are drawn past the gas venting valve 16** during venting of the mold cavity.

The diagonal channel 30 includes a central portal 40 that communicates with a generally cylindrical bore 42 formed in a cylindrical extension 25 of the housing 22 and in a housing end cap 27. The portal 40 and the cylindrical bore 42 are interconnected by a throat 43 of reduced cross-section. The portal 40 includes an annular, frusto-conical valve seat 48 that is concentric to the longitudinal axis L of the bore 42 and the throat 43. The portal 40 is disposed axially from the cylindrical bore 42 so as to be in gas flow communication with the gas conduit 18 via the channel 30.

A hollow piston 50 is received for sliding axial movement in the cylindrical bore 42. The hollow piston 50 includes an annular flange 52 defining radially extending first and second pressure responsive surfaces **52*a* and 54*a*, respectively, for moving the piston 50 in a respective first and second axial direction in the bore 42. In particular, application of fluid pressure to first surface 52*a* causes piston movement axially toward the portal 40 while application of fluid pressure on second surface 54*a* causes piston movement in the opposite axial direction away from the portal 40**.

Figure 2:
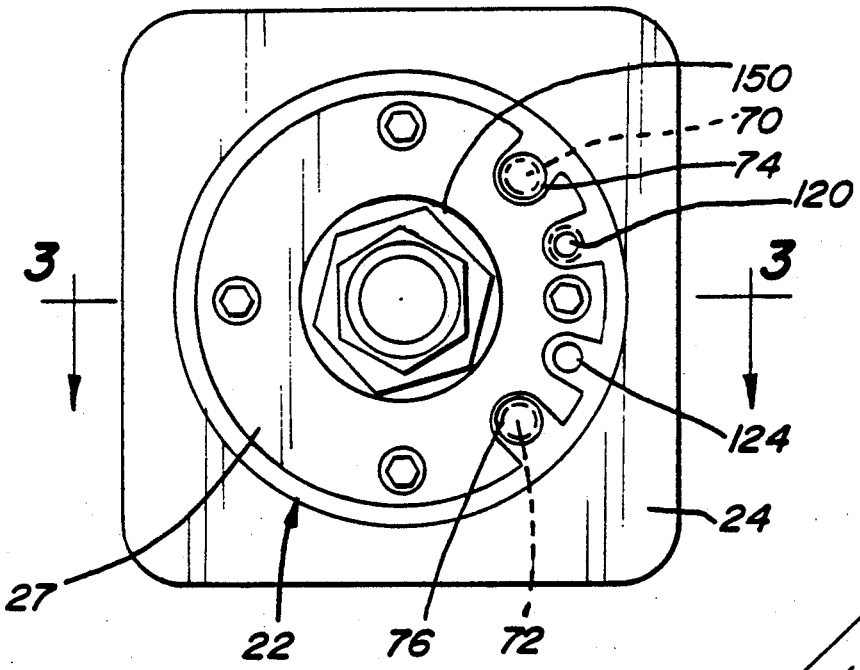
FIG. 2 is a top elevational view of the gas venting valve of the invention.

As shown best in FIG. 3, the piston 50 including first and second pressure responsive surfaces **52*a* and 54*a* of flange 52 cooperates with bore 42 to define first and second annular chambers 60, 62 for receiving pressurized fluid (e.g., hydraulic fluid) from respective fluid passages 70 and 72. Passages 70, 72 are connected to conventional threaded fittings 74, 76 threaded into the housing extension 25, as shown in FIGS. 2–3. Fittings 74, 76 are connected to a conventional solenoid valve (not shown) that provides pressurized hydraulic fluid to one of the chambers 60, 62 and connects the other of the chambers 60, 62 to drain and vice versa depending on whether the valve head 110** is in the open or closed position.

A pair of axially spaced apart o-ring seals 78, 80 is received in flange 52 for fluid leakage prevention purposes. Similarly, o-ring seals 82 and 84, 86 are provided on the housing extension 25 and housing end cap 27, respectively, for this same purpose. Moreover, dust sealing rings 88, 89 are provided on the housing extension 25 and end cap 27, respectively, for preventing entry of dust and other foreign matter.

As shown best in FIG. 3, the hollow piston 50 includes a central, axially extending gas venting passage 90 communicated to a hollow threaded fitting 94 having a nipple 96 on which a flexible vacuum hose 98 is sealingly received. As explained hereinbelow, a vacuum source 100 or an air pressure source 101, both shown schematically in FIG. 1, are alternately connected to the hose 98. The gas venting passage 90 communicates with the portal 40 and the throat 43 by means of a plurality of circumferentially spaced apart axially extending passages 102 formed in an internal support web 104 of the hollow piston 50.

A valve head 110 includes an elongate stem **110*a* threadably received in the support web 104 as shown in FIG. 3 such that the valve head 110 is located in the portal 40 for axial movement (with the piston 50) relative to the valve seat 48. A hexagonal recess 110*b* is provided in the bottom of the valve head to facilitate threading of the stem 110*a* into the web 104**.

The valve head 110 is movable between an open position (shown in phantom in FIG. 3) spaced axially from the valve seat 48 and a closed position (shown in solid in FIG. 3) with an annular, frusto-conical sealing surface **110*c* sealed against the valve seat. When the valve head 110 is in the open position, the gas conduit 18 communicates with the central bore 42 via the portal 40, throat 43 and passages 102 in the support web 104 to vent or withdraw gases from the mold cavity. In the closed position, the valve head 110 prevents such communication and prevents molten metal introduced into the mold cavity and ultimately flowing into conduit 18 from escaping therepast. The valve head 110, housing 22 and piston 50 are made of H-13 tool steel. The valve seat 48 as well as adjacent surfaces of the housing 22** exposed to abrasive action during die casting may be nitrided or otherwise surface treated for improved wear and abrasion resistance.

Referring to FIGS. 2 and 3, a cooling passage 120 is provided in the housing extension 25 to admit cooling fluid (e.g., water) from an external source (not shown) to cooling passages 122 in the housing base 24. The cooling fluid is then exhausted from the passages 122 through an exit passage 124 in the housing extension 25 to a return tank (not shown). Suitable threaded fluid fittings (not shown) are attachable to the passages 120, 124, respectively, for this purpose.

Figure 6:
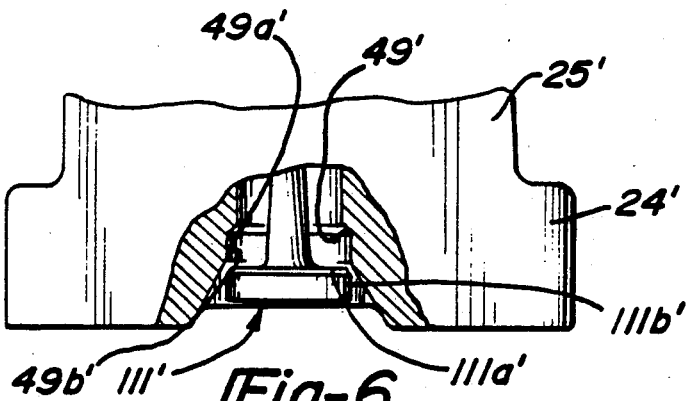
FIG. 6 is a side elevation of another embodiment of the invention sectioned to show a preferred configuration of the valve head and the valve seat.

FIG. 6 illustrates a preferred embodiment of the invention wherein the valve seat and the valve head have configurations different from those shown in FIG. 3 to provide dual sealing surfaces In FIG. 6, like features of FIG. 3 are represented by like reference numerals primed In particular, the valve seat 49' includes an annular, frusto-conical sealing seat **49*a*' and an adjacent cylindrical sealing surface 49*b*'. The valve head 111', in turn, includes a complementary annular, frusto-conical sealing surface 111*a*, to seal against seat 49*a*, and a cylindrical sealing surface 111*b*' to be sealingly received in the sealing surface 49*b*' when the valve head 111' is in the closed condition. The embodiment of FIG. 6 thus provides dual sealing surfaces In a typical process sequence for gas removal during die casting, the die sections 10, 12 are initially closed with the valve head 110 (or valve head 111') in the closed position Closure of the die sections 10, 12 actuates a limit switch (not shown) of a casting machine electronic control system to effect actuation of the vacuum source 100 and a conventional three-way, pilot operated switching valve 130, FIG. 1, to communicate the actuated vacuum source 100 and the hose 98. In particular, a control signal is sent by the machine control system to a solenoid 131 associated with the switching valve 130 to cause regulated air pressure (e.g., 40 psi through regulator 133) to be applied to the spool (not shown) of valve 130 so as to communicate the source 100 and hose 98**.

The actuated vacuum source 100 evacuates the flexible hose 98 and the gas venting passage 90 to the closed valve head 110. The shot sleeve (not shown) is then charged with a suitable amount of molten metal from a ladle for injection by a conventional shot rod (not shown) into the mold cavity. After the shot sleeve is charged, the shot rod is advanced After a preselected distance of travel, the shot rod actuates a shot rod travel limit switch (not shown) that, through the machine control system, causes a conventional hydraulic solenoid valve (not shown) to introduce pressurized hydraulic fluid to chamber 60 to act on the first, pressure responsive surface 52*a* of the piston 50. Hydraulic fluid in chamber 60 acts on first, pressure responsive surface 52*a* of the piston to move the valve head 110 (111') to the open position The shot rod continues its injection stroke to introduce the molten metal charge into the mold cavity The valve head 110 (111') is moved to the closed position sealed against the valve seat 48 (49') upon expiration of a preselected time period (i.e., after 10 seconds) Depending upon the particular die casting application involved, the time period is selected to provide closing of the valve head 110 (111') prior to the entry of the molten metal into the ingate of the mold cavity or, alternatively, after the mold cavity is partially filled (e.g., 25 percent filled) with the molten metal In any event, closure of the valve head 110 (111') occurs prior to deactuation of the vacuum source 100. The molten metal injected into the mold cavity flows through the gas conduit 18 to the closed valve head 110 (111'), which prevents escape of the molten metal therepast. The "crumb-catcher" channel 32 receives any solidified metal droplets (so-called crumb) drawn ahead of the molten metal in the conduit 18.

Upon shut-off of the vacuum source 100, the switching valve 130 is shifted (by a suitable control signal sent by the machine control system to the solenoid 131) to an "air blowout" position in preparation for subsequent supply of pressured air from air source 101 to the valve head 110 after the casting is ejected as will be explained hereinbelow.

The molten metal injected into the mold cavity is allowed to solidify in the mold cavity for a given time period (e.g., 40 seconds for an aluminum automatic transmission housing). The die sections 10, 12 are then opened to eject the solidified die casting After the die sections 10, 12 are opened and the casting is ejected, the valve head 110 (111') is moved to the open position. Air pressure regulated at 60 to 80 psi (by regulator 135) is then supplied to the hose 98 through the switching valve 130, FIG. 1, via a conventional on-off air control valve 142 in the air pressure line 150. To this end, the solenoid 140 of the air control valve 142 is actuated by the machine control system to cause the 60 to 80 psi pressurized air to be supplied by valve 142 to switching valve 130 in response to opening of the valve head 110 (111'). As mentioned hereinabove, the valve 130 is already in the "air blowout" position and permits the 60 to 80 psi pressurized air to enter the hose 98 for discharge past the opened valve head 110 (111').

The valve head 110 (111') is then moved to the closed position with the pressurized air (60 to 80 psi) continuing to flow through the hose 98. The valve head 110 (111') is kept closed for a period of time selected to develop the full 60 to 80 psi in the hose 98. The valve head 110 (111') is then again reopened (by hydraulic fluid applied to piston surface 52*a*) to discharge an air blast (at 60 to 80 psi) to clean any slivers/crumbs of solidified metal from the valve seat 48 (49') and/or valve head 110 (111'). During development of the full 60 to 80 psi air pressure in the hose 98, the fluid pressure applied on the second, pressure responsive surface 54*a* of the hollow piston 50 overcomes the build-up of air pressure behind the closed valve head 110 (111',) and thereby prevents the valve head from opening After the valve head 110 (111') is opened to discharge the air blast, the valve head is again closed with the pressurized air blowing through hose 98 so that a conventional lubrication and high pressure water treatment can be carried out on the die section 12. The valve head 110 (111') is reopened once again to blow off the die section 12. Finally, the air control valve 142 is closed after a given time period (established by an associated timer), the valve head 110 (111') is moved to the closed position and the die sections 10, 12 are closed to repeat the die casting sequence described hereinabove.

The gas venting valve 16 described hereinabove is advantageous in several respects Firstly, the service life of the valve is significantly increased as compared to the axial melt impingement type of gas removal valve. In particular, the valve seat and the valve head employed in the invention, especially those shown in FIG. 6, reduce burning of the valve. Moreover, the air blast cleaning of the valve seat and valve head after casting ejection also removes slivers/crumbs of solidified metal to increase the service life of the valve. In a particular die casting production application for aluminum automotive transmission housings, the gas removal valve of the invention has exhibited a service life an order of magnitude greater than that exhibited by an axial melt impingement valve used previously. Malfunctions of the gas venting valve of the invention in service are also substantially reduced.

Moreover, in the event the gas venting valve 16 requires maintenance or repair, it is easily removed from the die section 12 by removing the fasteners 28 and the flexible hose 98. Maintenance is simplified as a result of the simple construction of the valve and the small number of valve components used.

The gas venting valve 16 of the invention also has substantially improved capacity for removing gases from larger mold cavities (i.e., the valve 16 has an enhanced evacuation area). In particular, the smallest restriction in the gas venting valve 16 is located between the valve stem 110*a* and the throat 43. The area of this restriction can be selected to maximize the evacuation area of the valve to permit faster evacuation of a given size mold cavity so that the valve head can be closed prior to impingement of molten metal on the valve head. For purposes of illustration, an effective evacuation area of about 1.1 $in^2$ has been employed to satisfactorily evacuate a mold cavity and sleeve volume of about 1383 $in^3$ in about one second.

Furthermore, the gas venting valve of the invention is not limited to peripheral installation in a cylindrical receptacle at the parting plane between the die sections 10, 12. Instead, the valve 16 can be installed at various locations on the surface 12*a* of the die 12 with the base 24 aligned only with the surface 12*a* as described hereinabove. As a result, the gas venting valve of the invention can accommodate die mismatch in lateral and vertical directions in FIG. 1. In other words, die alignment requirements are substantially reduced by the gas venting valve 16 of the invention.

While the invention has been described by a detailed description of certain specific and preferred embodiments, it is to be understood that various modifications and changes can be made therein within the scope of the appended claims which are intended to include equivalents of such embodiments.

The embodiments of the invention in which an exclusive property or privilege is claimed are defined as follows:

1. A gas venting valve for use in combination with a material-forming mold or die cavity to control venting of gas through a gas conduit communicating with said cavity, said valve having an open position for allowing gas flow through said conduit and a closed position for preventing the escape of material therepast, said valve comprising:

a housing having a generally cylindrical bore with a longitudinal axis and a portal to said bore disposed axially relative to said bore so as to communicate with said gas conduit and including a valve seat, a hollow piston slidably received in said bore and having an axially extending gas venting passage in communication with said portal when said valve is in the open position for venting gas from said ,portal, said piston including a first radially extending surface responsive to fluid pressure for moving the piston in a first axial direction and a second radially extending surface responsive to fluid pressure for moving said piston in a second axial direction opposite said first direction, a valve head located in said portal and connected to said piston for axial movement therewith relative to the valve seat to establish the open position of said valve wherein the valve head is spaced apart axially from the valve seat to allow gas flow therebetween and the closed position of said valve wherein the valve head is sealed against the valve seat, means for supplying pressurized fluid to said first surface to move the valve to the open position, and means for supplying pressurized fluid to said second surface to move the valve to the closed position.

2. A gas venting valve for use in combination with a material-forming mold or die cavity to control venting of gas through a gas conduit communicating with the cavity, said valve having an open position for allowing gas flow through said conduit and a closed position for preventing the escape of material therepast, said valve comprising:

a housing having a generally cylindrical bore with a longitudinal axis, and a portal to said bore disposed axially relative to said bore so as to communicate with said gas conduit and including a valve seat, a hollow piston slidably received in said bore and having a central gas venting passage in communication with said portal when said valve is in the open position for venting gas from said portal, said piston comprising a flange slidably received in said chamber and including a first surface responsive to fluid pressure for moving the piston in a first axial direction and a second surface responsive to fluid pressure for moving said piston in a second axial direction opposite said first direction, a valve head located in said portal and connected to said piston for axial movement therewith relative to the valve seat to establish the open position of said valve wherein the valve head is spaced apart axially from the valve seat to allow gas flow therebetween and the closed position of said valve wherein the valve head is sealed against the valve seat, means for supplying pressurized fluid to the piston flange first surface to move the valve to the open position, and means for supplying pressurized fluid to the piston flange second surface to move the valve to the closed position.

3. A gas venting valve for use in a metal die casting die to vent gas from a cavity therein, said valve communicating with a gas conduit in said die and having an open position for allowing gas flow through said conduit and a closed position for preventing the escape of cast metal therepast, said valve comprising a housing having a generally cylindrical bore with a longitudinal axis and a portal to said bore disposed axially relative to said bore so as to communicate with the gas conduit and including a valve seat, a hollow piston slidably received in said bore and having a central gas venting passage in communication with said portal when the valve is in the open position for venting gas from said portal, said piston cooperating with said bore to define axially spaced first and second fluid chambers and comprising an annular flange including a first surface communicating with said first chamber and responsive to fluid pressure therein for moving the piston in a first axial direction and second surface communicating with said second chamber and responsive to fluid pressure therein for moving said piston in a second axial direction opposite said first direction, a valve head located in said portal and connected to said piston for axial movement therewith relative to the valve seat to establish the open position of said valve wherein the valve head is spaced apart axially from the valve seat to allow gas flow therebetween and the closed position of said valve wherein the valve head is sealed against the valve seat, means for supplying pressurized fluid to the first chamber to move the valve to the open position, and means for supplying pressurized fluid to the second chamber to move the valve to the closed position.

4. The valve in accordance with claim 3, wherein said valve further comprises vacuum means connected to said central gas passage at an end remote from said housing portal for withdrawing gas from the die cavity when the valve is in the open position.

5. The valve of claim 4 wherein said valve further comprises a source of fluid pressure and means for alternately connecting the gas venting passage to the source of fluid pressure for discharge past the valve head when the valve head is in the open position to clean said valve head.

6. The valve of claim 3 wherein said hollow piston includes an internal support web axially disposed between the central gas passage and the portal, said web having a plurality of axially extending gas passages therethrough to communicate the portal and the central gas passage when the valve head is in the open position.

7. The valve of claim 6 wherein the valve head is connected to the internal support web.

* * * * *